US006703980B2

(12) United States Patent
Chekroun et al.

(10) Patent No.: US 6,703,980 B2
(45) Date of Patent: Mar. 9, 2004

(54) ACTIVE DUAL-POLARIZATION MICROWAVE REFLECTOR, IN PARTICULAR FOR ELECTRONICALLY SCANNING ANTENNA

(75) Inventors: Claude Chekroun, Gif sur Yvette (FR); Serge Drabowitch, Chatenay-Malabry (FR)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/088,509

(22) PCT Filed: Jul. 20, 2001

(86) PCT No.: PCT/FR01/02383

§ 371 (c)(1),
(2), (4) Date: Mar. 28, 2002

(87) PCT Pub. No.: WO02/11238

PCT Pub. Date: Feb. 7, 2002

(65) Prior Publication Data

US 2002/0145492 A1 Oct. 10, 2002

(30) Foreign Application Priority Data

Jul. 28, 2000 (FR) ..... 00 09975

(51) Int. Cl.[7] ..... H01Q 19/08
(52) U.S. Cl. ..... 343/755; 343/754
(58) Field of Search ..... 343/754, 854, 343/753, 755, 731, 781 CA; 342/188

(56) References Cited

U.S. PATENT DOCUMENTS

| | | | |
|---|---|---|---|
| 3,308,469 A | 3/1967 | Drabowitch | 343/778 |
| 3,380,052 A | 4/1968 | Drabowitch et al. | 343/16 |
| 3,553,692 A | 1/1971 | Drabowitch | 343/778 |
| 3,568,184 A | 3/1971 | Drabowitch et al. | 343/5 |
| 3,706,998 A | 12/1972 | Hatcher et al. | 343/754 |

(List continued on next page.)

OTHER PUBLICATIONS

J. Shaker et al.: "A novel dual orthogonal polarisation planar reflector for LMCS applications" IEEE VTS 50$^{TH}$ Vehicular Technology Conference, vol. 3, pp. 1943–1945 Sep. 19, 1999–Sep. 22, 1999.

J.K. Hsiao: "Analysis of interleaved arrays of waveguide elements" IEEE Transactions on Antennas and Propagation, vol. AP–19, No. 6, pp. 729–735 11/71.

*Primary Examiner*—James Clinger
(74) *Attorney, Agent, or Firm*—Oblon, Spivak, McClelland, Maier & Neustadt, P.C.

(57) ABSTRACT

A dual polarization active microwave reflector with electronic scanning, configured to be illuminated by a microwave source to form an antenna. The reflector includes two imbricated waveguide arrays, the bottom of each waveguide array being closed by a phase shift circuit carrying out the reflection and the phase shifting of the wave that it receives. One of the two waveguide arrays is configured to receive a first polarization and the other waveguide array is configured to receive a polarization perpendicular to the first polarization.

10 Claims, 5 Drawing Sheets

U.S. PATENT DOCUMENTS

Figure 1:
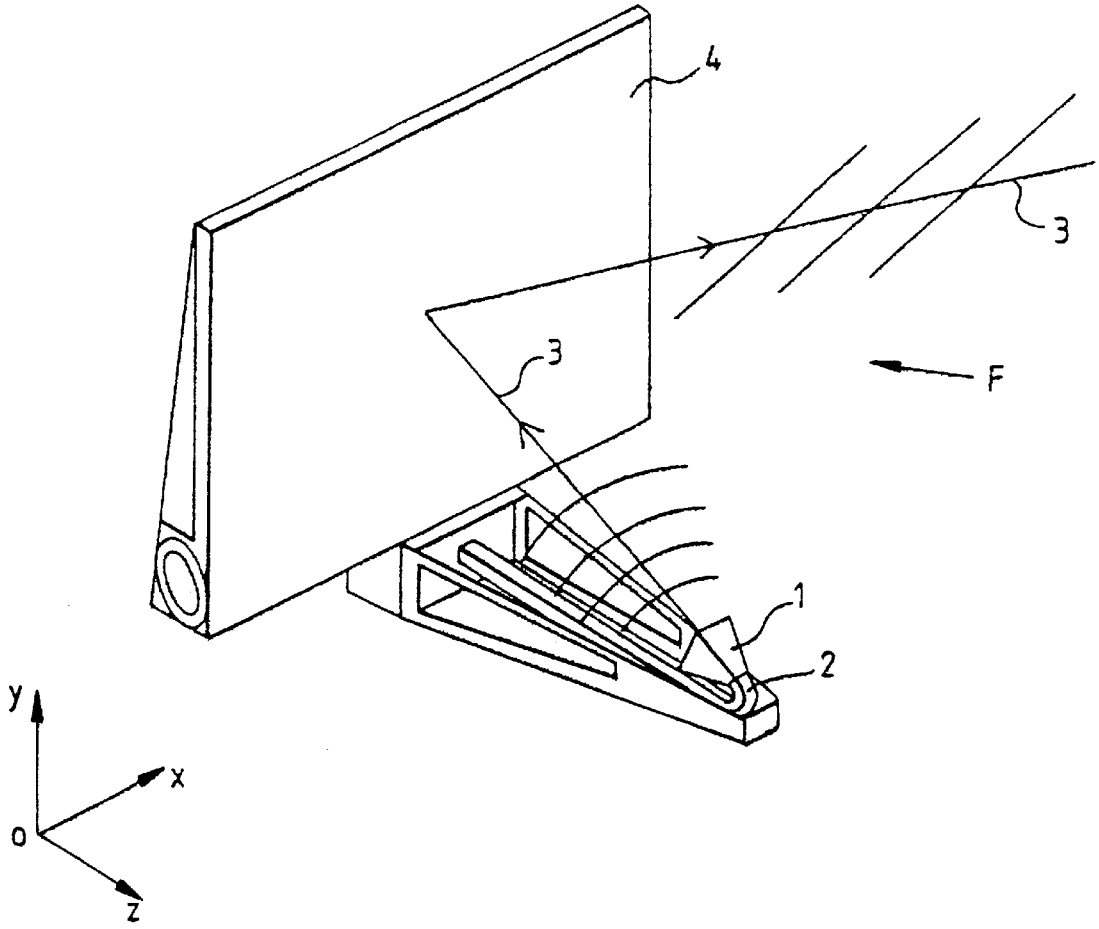

| | | | | | |
|---|---|---|---|---|---|
| 3,750,183 | A | | 7/1973 | Drabowitch | 343/786 |
| 3,761,943 | A | | 9/1973 | Harper et al. | 343/755 |
| 3,828,352 | A | | 8/1974 | Drabowitch et al. | 343/837 |
| 3,964,070 | A | | 6/1976 | Drabowitch | 343/786 |
| 3,978,484 | A | * | 8/1976 | Collier | 343/754 |
| 4,048,592 | A | | 9/1977 | Drabowitch | 333/6 |
| 4,185,286 | A | | 1/1980 | Drabowitch et al. | 343/754 |
| 4,212,014 | A | | 7/1980 | Chekroun | 343/754 |
| 4,223,316 | A | | 9/1980 | Drabowitch | 343/781 P |
| 4,320,404 | A | | 3/1982 | Chekroun | 343/854 |
| 4,322,731 | A | | 3/1982 | Drabowitch | 343/895 |
| 4,338,607 | A | | 7/1982 | Drabowitch | 343/754 |
| 4,344,077 | A | | 8/1982 | Chekroun et al. | 343/754 |
| 4,447,815 | A | | 5/1984 | Chekroun et al. | 343/754 |
| 4,513,291 | A | | 4/1985 | Drabowitch | 343/771 |
| 4,544,925 | A | | 10/1985 | Drabowitch et al. | 343/18 E |
| 4,665,405 | A | | 5/1987 | Drabowitch et al. | 343/756 |
| 4,672,378 | A | | 6/1987 | Drabowitch et al. | 342/17 |
| 4,713,663 | A | | 12/1987 | Drabowitch et al. | 342/70 |
| 4,740,791 | A | | 4/1988 | Drabowitch et al. | 342/368 |
| 4,792,811 | A | | 12/1988 | Aubry et al. | 343/781 CA |
| 4,853,701 | A | | 8/1989 | Drabowitch | 342/139 |
| 4,857,936 | A | | 8/1989 | Drabowitch et al. | 342/368 |
| 4,864,221 | A | | 9/1989 | Fouche et al. | 324/83 R |
| 4,968,969 | A | | 11/1990 | Drabowitch et al. | 342/188 |
| 5,001,495 | A | | 3/1991 | Chekroun | 343/754 |
| 5,008,677 | A | | 4/1991 | Trigon et al. | 342/17 |
| 5,144,327 | A | | 9/1992 | Chekroun et al. | 343/731 |
| 5,237,328 | A | | 8/1993 | Dorey et al. | 342/13 |
| 5,262,788 | A | | 11/1993 | Drabowitch et al. | 342/188 |
| 5,548,289 | A | | 8/1996 | Chekroun et al. | 342/16 |
| 5,598,172 | A | | 1/1997 | Chekroun | 343/754 |
| 5,635,939 | A | | 6/1997 | Chekroun | 342/16 |
| 5,680,136 | A | | 10/1997 | Chekroun | 342/6 |
| 6,191,748 | B1 | | 2/2001 | Chekroun et al. | 343/754 |

* cited by examiner

ACTIVE DUAL-POLARIZATION MICROWAVE REFLECTOR, IN PARTICULAR FOR ELECTRONICALLY SCANNING ANTENNA

The present invention relates to a dual polarization active microwave reflector with electronic scanning, capable of being illuminated by a microwave source in order to form an antenna.

It is known to produce antennas comprising an active microwave reflector. The latter, also called a "reflect array", is an array of phase shifters which can be controlled electronically. This array lies in a plane and comprises an array of elements with phase control, or a phased array, placed in front of the reflecting means, consisting, for example, of a metal ground plane forming a ground plane. The reflecting array especially comprises elementary cells each one producing reflection and phase shifting, variable by electronic control, of the microwave that it receives. An antenna of this sort provides considerable beam agility. A primary source, for example a horn, placed in front of the reflecting array emits microwaves toward the latter.

One aim of the invention is especially to make it possible to produce an electronic scanning antenna using an active reflecting array and operating with two independent polarizations. To this end, the subject of the invention is an active microwave reflector, capable of receiving an electromagnetic wave, comprising two imbricated waveguide arrays. The bottom of each guide is closed by a circuit carrying out the reflection and the phase shifting of the wave that it receives, one array being designed to receive one polarization and the other array being designed to receive a polarization perpendicular to the previous one.

One embodiment may be such that:

- a first array comprises several sets of aligned guides, one row lying in a direction Ox and the set of rows lying in a perpendicular direction Oy, for the same row, the centers C of two consecutive guides being separated by a distance d, two consecutive rows being separated by a distance h, along Oy, and offset one with respect to the other by the distance d/2, along Ox;
- the second array comprises several sets of guides aligned in the same way as in the first array, the rows being offset by an angle of 90° with respect to those of the first array;
- a guide of one array is contiguous only with guides of the other array.

The subject of the invention is also an electronic scanning antenna comprising a reflector as defined above. This antenna may, for example, be of the "Reflect Array" type or of the Cassegrain type.

The particular advantages of the invention are that it makes it possible to obtain a compact, low-weight reflector, that it is simple to use and that it is economical.

Figure 2:
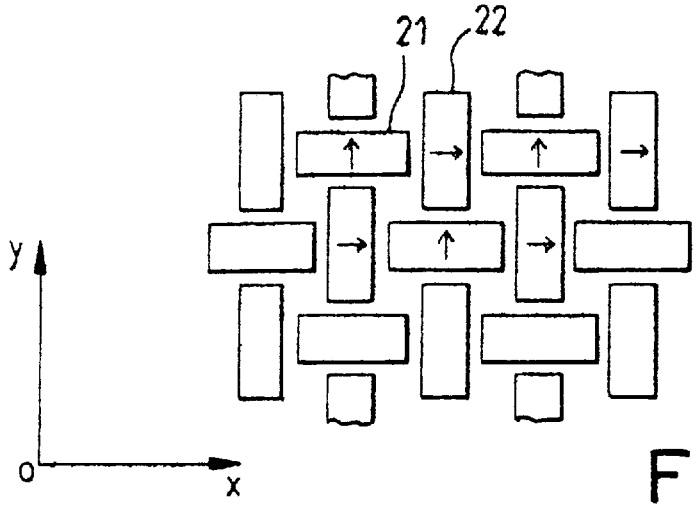
Figure 3:
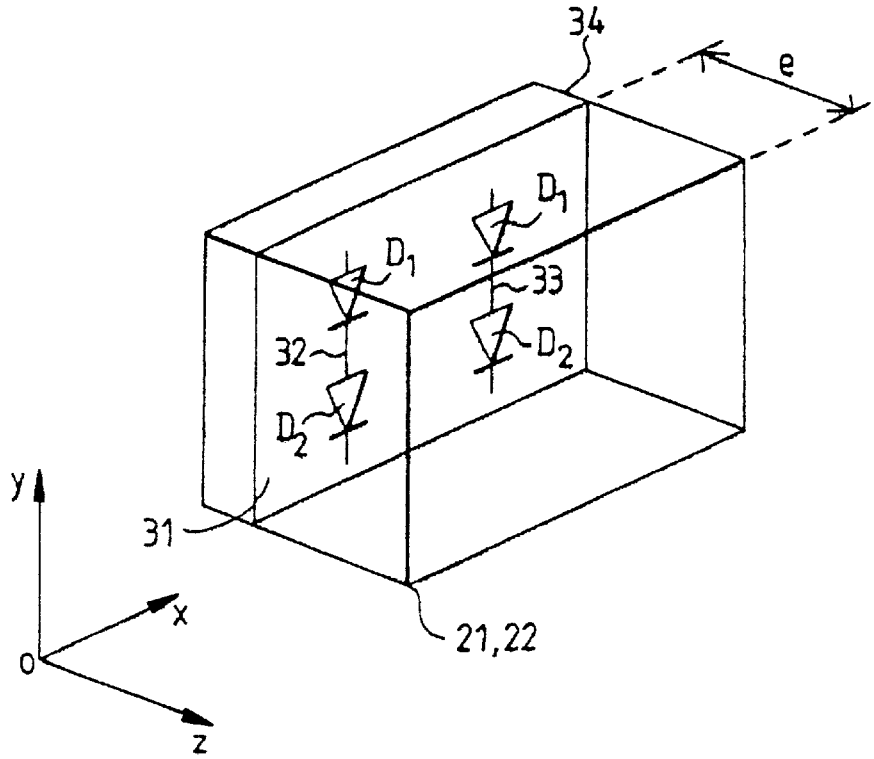
Figure 4A:
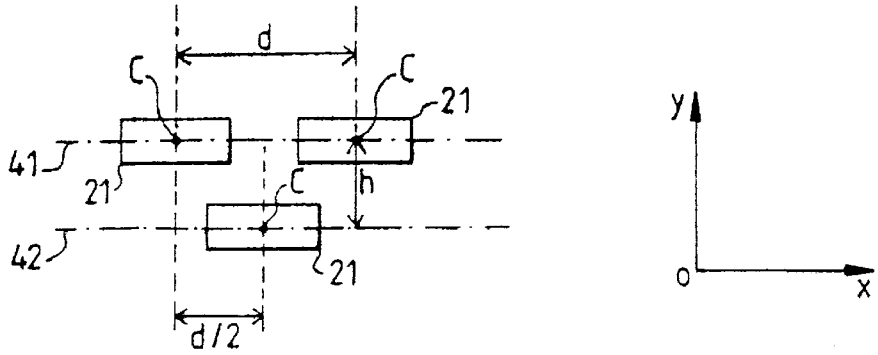
Figure 4B:
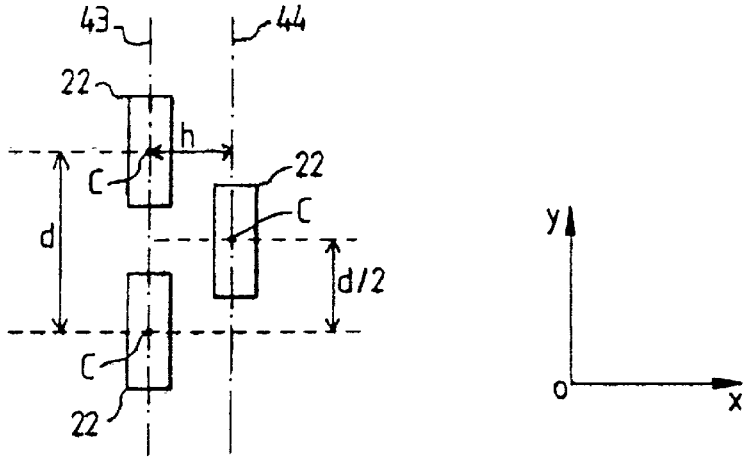
Figure 4C:
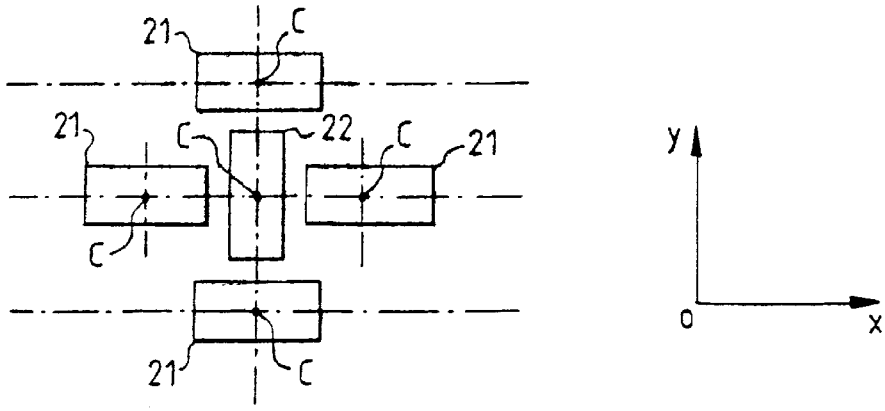
Figure 5:
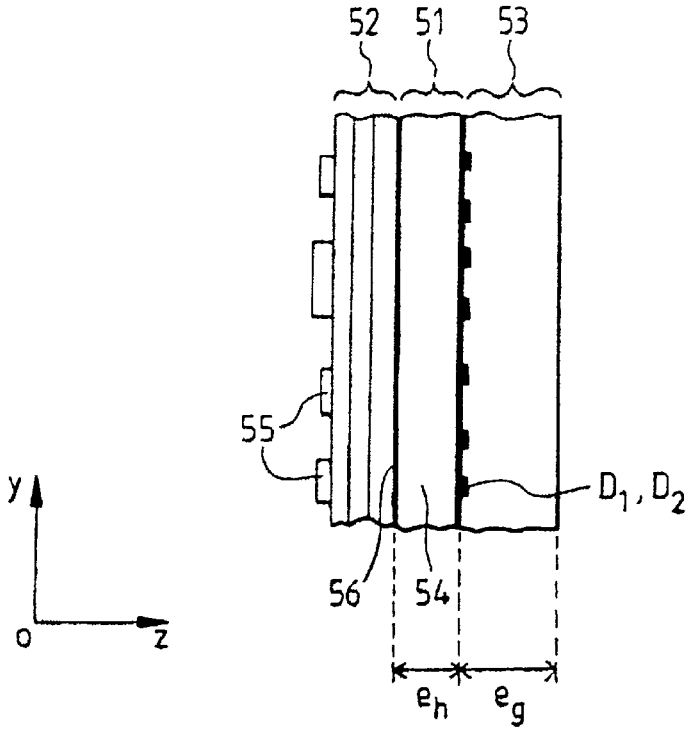
Figure 7:
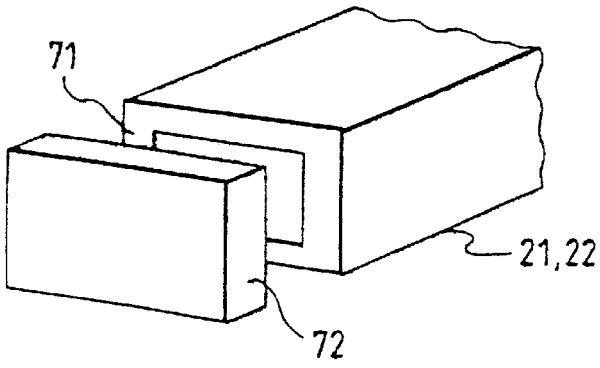
Figure 6:
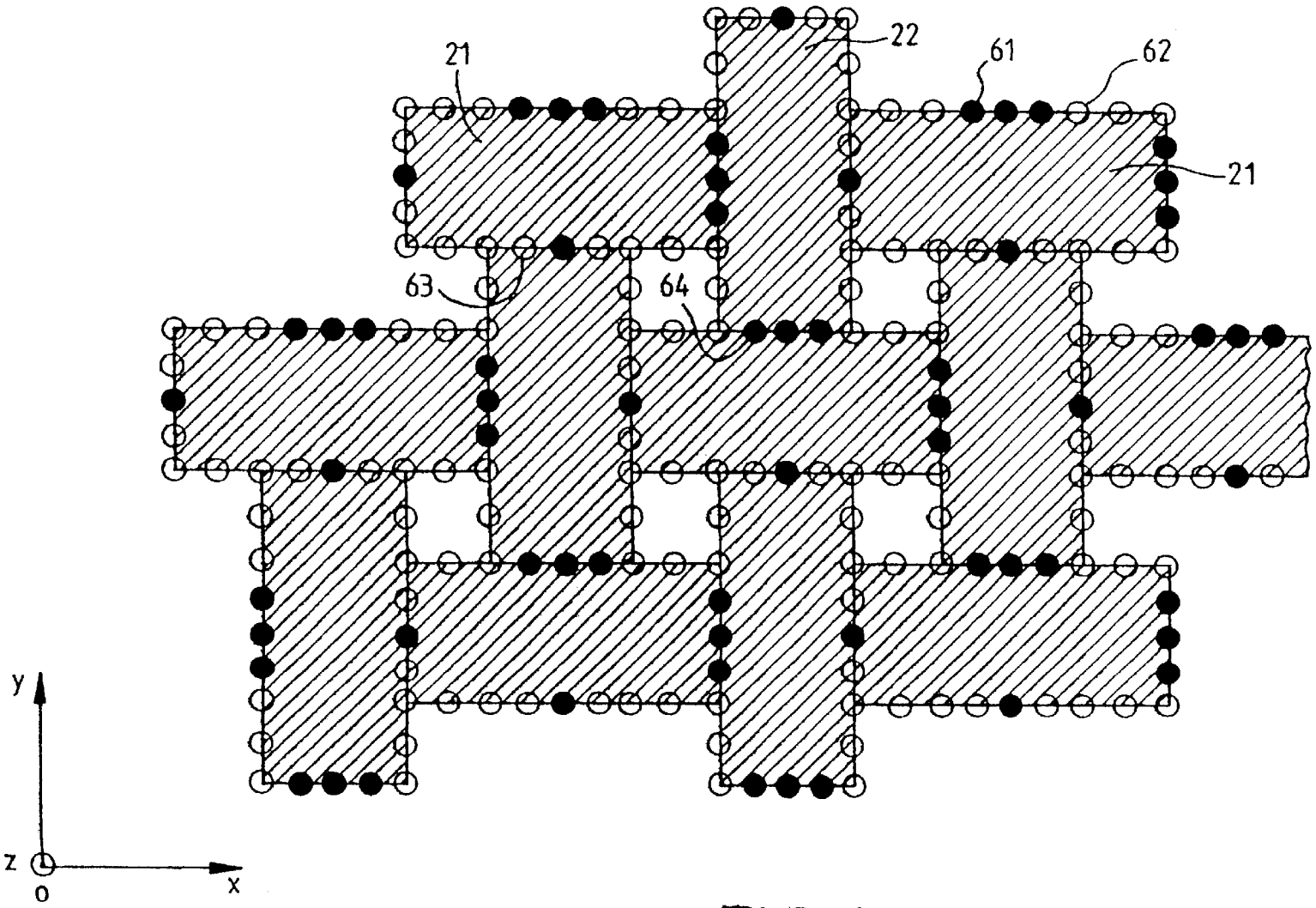

Other characteristics and advantages of the invention will become apparent using the following description made with reference to the appended drawings which show:

- FIG. 1, an exemplary embodiment of an electronic scanning antenna with an active microwave reflector;
- FIG. 2, an illustration of the principle for producing a reflector according to the invention;
- FIG. 3, an exemplary embodiment of a phase shift cell;
- FIGS. 4*a*, 4*b* and 4*c*, an illustration of a possible imbrication mode of the arrays of guides of a reflector according to the invention;
- FIG. 5, by means of a sectional view, the possible layers constituting a reflector according to the invention;

- FIG. 6, a possible embodiment of the arrays of guides of a reflector according to the invention;
- FIG. 7, an additional embodiment especially making it possible to reduce the standing wave ratio.

FIG. 1 schematically illustrates an exemplary embodiment of an electronic scanning antenna with an active reflecting array with respect to an orthonormal coordinate system Oxyz. In this exemplary embodiment, the microwave distribution is, for example, of the so-called optical type, that is to say, for example, provided using a primary source illuminating the reflecting array. To this end, the antenna comprises a primary source 1, for example a horn. The primary source 1 emits microwaves 3 toward the active reflecting array 4, placed in the plane Oxy. This reflecting array 4 comprises a set of elementary cells producing the reflection and the phase shifting of the waves that they receive. Thus, by controlling the phase shifts impressed onto the wave received by each cell, it is possible, as is known, to form a microwave beam in the desired direction. With a reflector according to the invention, the primary source 1 may be with double polarization.

FIG. 2 illustrates the principle of producing a reflector according to the invention. The latter comprises two imbricated waveguide arrays 21, 22. These guides are viewed along F, that is to say along an end-on view of the reflector 4. The figure therefore especially shows the cross section of the guides in the plane Oxy, the walls of the guides lying in the direction Ox. Each guide belongs to an elementary cell, as mentioned above. A first guide array 21 is designed to receive the vertical polarization and a second guide array 22 is designed to receive the horizontal polarization. The incident microwaves 3 enter the guides. Each guide 21, 22 is short-circuited by a phase shifter, as described, for example, in French patent application No. 97 01326, which can be controlled with two to four bits or more.

FIG. 3 schematically illustrates a phase shift cell. This therefore comprises a guide 21, 22 and a phase shift circuit 31, the latter being placed at the bottom of the guide in the plane Oxy. A phase shift circuit 31 comprises at least one conducting wire 32, 33, itself carrying at least two semiconductors $D_1$, $D_2$, for example diodes, with two states. The conducting wires and the diodes are placed on a dielectric support 34, the opposing face of which comprises a conducting plane reflecting the microwave. This conducting plane is, for example, in electrical contact with the walls of the guide 21, 22. An elementary cell 31 then carries out the reflection and the phase shifting of the microwave 3 that it receives for the component of the wave whose polarization is substantially parallel to the conducting wires 32, 33. By way of example, the cell of the sort illustrated in FIG. 3 acts on a wave polarized in the direction Oy parallel to the direction of the conducting wires 32, 33 of the cell. In horizontal polarization, only the guides designed to receive this polarization are active, the others being short-circuited. Similarly, in vertical polarization, only the guides designed to receive this polarization are active, the others being short-circuited.

FIGS. 4*a*, 4*b* and 4*c* illustrate a possible imbrication mode of the two guide arrays. FIG. 4*a* shows three guides 21 of the first array, representing a grid, designed for example to receive the vertical polarization. FIG. 4*b* shows three guides 22 of the second array, representing a grid, designed for example to receive the horizontal polarization. In any case, the two arrays are designed to receive waves with crossed polarizations, the second array of guides 22 being allocated to a polarization perpendicular to the polarization of the first array of guides 21. The cross section of each guide comprises a midpoint C. Since this cross section is angular, the midpoint C is the intersection of its two mid lines. The cross sections of the guides are shown in the plane Oxy of the reflector. By way of example, the axis Ox is considered to correspond to the direction of a first polarization. Similarly, the axis Oy is considered to correspond to the direction of the second polarization, crossed with respect to the first. For the purpose of simplification and by way of example, hereinafter, the direction Oy may be considered equivalent to the vertical direction and the direction Ox to the horizontal direction.

FIG. 4*a* therefore shows a first array of guides 21 designed to receive the vertical polarizations. The array comprises several sets of aligned guides. One row of guides lies in the horizontal direction Ox and the set of rows lies in the vertical direction Oy. For the same row, the centers C of two consecutive guides 21 are separated by a distance d. Two consecutive rows are separated by a distance h, along Oy, and offset one with respect to the other by the distance d/2, along Ox. In other words, two consecutive mid lines 41, 42 are a distance h apart, the mid-lines being the mid-lines of the guides taken along Ox. Between two consecutive rows, there is an offset of d/2 of the midpoints of the guides.

FIG. 4*b* shows the second array of guides 22 designed to receive the horizontal polarization. The arrangement of the guides is similar to that of the array of FIG. 4*a*, but with a rotation of the set by 90°. In this case, the rows lie along the axis Oy and the set of rows lies along the axis Ox. For the same row, the centers C of two consecutive guides 22 are separated by a distance d. Two consecutive rows are separated by a distance h, along Ox, and offset one with respect to the other by the distance d/2, along Oy. In other words, two consecutive mid lines 43, 44 are a distance h apart, the mid lines being the mid-lines of the guides taken along Oy. Between two consecutive rows, there is an offset of d/2 of the midpoints of the guides.

FIG. 4*c* defines the imbrication of the two arrays of guides by showing how a guide 22 of one array is positioned with respect to the guides 21 of the other array. This guide 22 is contiguous only with guides 21 of the other array. In the case of FIG. 4*c*, the guide 22 is contiguous with four guides 21 of the other array. The midpoint C of this guide 22 is aligned with the midpoints of the two pairs of guides 21 surrounding the guide 22. Thus a lattice, as illustrated in FIG. 2, is obtained. The internal dimensions of the waveguides 21, 22 are, for example, 0.6 λ and 0.3 λ (λ=length of the wave 3) in length and in width, respectively, the length of the guides lying along the rows of the arrays. The distance d between the midpoints C of two consecutive guides of the same row is then, for example, equal λ and the distance h between the mid lines 41, 42, 43, 44 of two consecutive rows is, for example, λ/2. By way of example, for a microwave 3 at 10 GHz, the internal dimensions of a waveguide are 1.8 cm and 0.9 cm, and the distances d and h are 3 cm and 1.5 cm, respectively. This lattice especially makes it possible for the beam reflected by the reflector 4 to be deflected over a cone of about 60°.

FIG. 5 shows, by means of a sectional view, the possible layers constituting a reflector according to the invention. It comprises at least three layers 51, 52, 53. A first layer 51 comprises the microwave phase shift circuits, that is to say in particular the diodes $D_1$, $D_2$, the conducting wires which carry them and the associated connection circuits. The microwave circuits are for example supported by a substrate 54. On the face opposite the microwave circuits, this substrate is covered with a metalized layer 56, forming a conducting plane, which especially has the function of reflecting the microwaves 3. In the X band, the thickness $e_h$ of the substrate is, for example, about 3 mm, the relative dielectric constant $\epsilon_r$ being about 2.5. A second layer 52 comprises the circuits 55 for controlling the diodes $D_1$, $D_2$ of the phase shifters. This layer moreover provides the connection between the control circuits and the diodes. To this end, it has, for example, the structure of a multilayer printed circuit comprising planes interconnecting the control circuits to the microwave circuits. Finally, a third layer 53, placed facing the microwave circuits $D_1$, $D_2$, comprises the two waveguide arrays.

FIG. 6 shows a possible embodiment of the layer of waveguides 53. This embodiment is especially easy to implement. The walls of the guides 21, 22 are made by plated-through holes 61, 62 oriented in the direction Oz. These plated-through holes could be replaced by conducting wires, that is to say rectilinear electrical conductors, oriented in the direction Oz. The guides thus produced have, for example, common wall parts, that is to say that plated-through holes 63, 64 are common to two guides. In this case, two neighboring guides have plated-through holes in common. The plated-through holes are made in a dielectric plate of thickness $e_g$, this thickness constituting the length of the guides. The plated-through holes are sufficiently close to act as waveguide walls. These plated-through holes 61, 62 therefore pass through the entire third layer 53. They extend into the microwave layer 51 in order to reach the conducting plane 56. They thus make it possible moreover to electromagnetically decouple each phase shift circuit 32, 33, $D_1$, $D_2$ from its neighbors by forming an electromagnetic shield. There is then no wave propagation from one cell to the other. Advantageously, some plated-through holes 61, 64 may extend into the layer 52 comprising the control circuits. These extending holes especially make it possible to connect the control circuits electrically to the diodes of the phase shift circuits of the microwave layer 51. These plated-through holes 61, 64 thus carry the control of the diodes and the electrical supply of the circuits. They are for example connected to the various interconnection planes of the control layer 52. By way of example, the plated-through holes 61, 64 shown in black are also used for the supply and the control of the microwave circuits. These holes 61, 64 especially pass through the conducting plane 56 with no electrical contact therewith. The other holes 62, 63 stop, for example, at this conducting plane 56, in electrical contact therewith. The thickness $e_g$ of the waveguide layer is for example about one centimeter. It is necessary for example to provide hollows in this layer 53 of guides in order to house the diodes $D_1$, $D_2$ of the microwave layer 51. Advantageously, the weight of a reflector according to the invention is low because of the low weight of the various layers. Moreover, despite the waveguide layer, the reflector still remains compact.

FIG. 7 illustrates an additional embodiment making it possible especially to reduce the standing wave ratio (SWR) active in the guides. The input of the guides 21, 22 comprises an iris 71 with a rectangular opening, the assembly being closed by a dielectric plate 72. In this embodiment, the waveguide layer 53 may be covered with a layer forming the irises, the assembly being closed by a dielectric layer.

A reflector according to the invention may be used for various types of antennas. It may be used as illustrated in FIG. 1 to form an antenna of the "reflect array" type. Similarly, it may be used in an antenna of the Cassegrain type. In the latter case, the primary source is placed at the center of the reflector and illuminates an auxiliary reflector. In its turn, the latter illuminates, by reflection, the reflector according to the invention.

A reflector or an antenna according to the invention are simple to use. They are also economical, since the components and the technologies used are cheap. Moreover, the invention provides all the advantages connected with dual polarization. An antenna according to the invention may thus, for example, be used for polarimetry measurements on targets, especially by emitting with one polarization and receiving with the other polarization. It may be used in telecommunications applications, for example dual-band applications.

What is claimed is:

1. An active microwave reflector, configured to receive an electromagnetic wave, comprising:

a phase shift circuit configured to carry out reflection and phase shifting of a received wave;

first and second waveguide arrays, each having a bottom closed by said phase shift circuit, said first waveguide array configured to receive a wave with a first polarization and said second waveguide array configured to receive a wave with a second polarization perpendicular to the first polarization; and said first and second waveguide arrays have guides formed at points of a grid such that two adjacent points of said grid along directions parallel to sides of the grid correspond to a guide of said first waveguide array and a guide of said second waveguide array.

2. The reflector as claimed in claim 1, wherein:

the first waveguide array comprises plural rows of aligned guides, one row lying in a direction Ox and other rows lying in a perpendicular direction Oy, for a same row, centers of two consecutive guides being separated by a distance d, two consecutive rows being separated by a distance h, along Oy, and offset one with respect to the other by the distance d/2, along Ox;

the second waveguide array comprises plural rows of guides aligned in a same way as in the first waveguide array, said rows of the second waveguide array offset by an angle of 90° with respect to said rows of the first waveguide array; and a guide of one array is contiguous only with guides of the other array.

3. The reflector as claimed in claim 1, further comprising at least first, second, and third layers:

the first layer comprising the phase shift circuits;

the second layer comprising control circuits configured to control the phase shift circuits, the second layer further providing connection between the control circuits and diodes; and the third layer, placed facing the phase shift circuits, comprising the first and second waveguide arrays.

4. The reflector as claimed in claim 3, wherein walls of the first and second waveguide arrays are formed of closely-spaced rectilinear electrical conductors passing through the third layer and oriented perpendicular to a plane of the phase shift circuits.

5. The reflector as claimed in claim 4, wherein the first and second waveguide arrays further pass through the first layer comprising the phase shift circuits and conductors providing microwave decoupling between neighboring phase shift circuits.

6. The reflector as claimed in claim 5, wherein the closely-spaced rectilinear electrical conductors enter the second layer to carry control signals toward the first layer comprising the phase shift circuits.

7. The reflector as claimed in claim 4, wherein the closely-spaced rectilinear electrical conductors are plated-through holes.

8. The reflector as claimed in claim 1, wherein the phase shift circuit comprises:

a dielectric support;

at least one conducting wire placed on a face of said dielectric support;

at least two semiconductors with two states, placed on said face of said dielectric support;

said dielectric support has an opposing face that comprises a conducting plane configured to reflect a microwave; and a component of said received wave has a polarization substantially parallel to the at least one conducting wire.

9. A microwave antenna with electronic scanning, comprising a reflector as claimed in claim 1, and a microwave source illuminating the reflector.

10. A microwave antenna with electronic scanning, comprising a reflector according to claim 1, an antenna of the Cassegrain type, and a microwave source located substantially at a center of the reflector to illuminate an auxiliary reflector, which illuminates the reflector by reflection.

* * * * *